US007182077B2

(12) United States Patent
Ward

(10) Patent No.: US 7,182,077 B2
(45) Date of Patent: Feb. 27, 2007

(54) HIGH ENERGY DENSITY INDUCTIVE COILS FOR APPROXIMATELY 300 MA SPARK CURRENT AND 150 MJ SPARK ENERGY FOR LEAN BURN ENGINES

(76) Inventor: Michael A. V. Ward, 32 Prentiss Rd., Arlington, MA (US) 02476

( * ) Notice: Subject to any disclaimer, the term of this patent is extended or adjusted under 35 U.S.C. 154(b) by 0 days.

(21) Appl. No.: 11/438,946

(22) Filed: May 23, 2006

(65) Prior Publication Data

US 2006/0266340 A1 Nov. 30, 2006

Related U.S. Application Data

(60) Provisional application No. 60/684,079, filed on May 24, 2005, provisional application No. 60/775,644, filed on Feb. 22, 2006.

(51) Int. Cl.
*F02P 3/02* (2006.01)

(52) U.S. Cl. ..... 123/634; 361/263

(58) Field of Classification Search ..... 123/634; 361/263
See application file for complete search history.

(56) References Cited

U.S. PATENT DOCUMENTS 5,315,982 A * 5/1994 Ward et al. ..... 123/634
6,142,130 A * 11/2000 Ward ..... 361/263
6,545,415 B1 * 4/2003 Ward ..... 123/634

* cited by examiner

*Primary Examiner*—Erick Solis
(74) *Attorney, Agent, or Firm*—Burns & Levinson LLP; Jerry Cohen

(57) ABSTRACT

A high energy density and high efficiency inductive ignition coil for IC engine achieved by the use of biasing magnets (14/15) located at the end (16/17) of an open-E laminated core to raise the coil energy to five times typical, i.e. of approximately 150 mj and to double the coil efficiency including novel use of coil winding structure (12/13/20/21) with a primary winding turns (Np) of between 70 and 86 and primary inductance Lp of between 700 uH and 1,100 uH, and a low turns ratio (Nt) of 53 to 67 allowing for a short, efficient, cylindrical coil, with secondary turns (Ns) of 4,000 to 5,000 turns with current of approximately 330 ma which is predominantly in the high glow and low arc discharge mode, with a special ratio R defined as Np/Nt and equal to between 1.15 to 1.45, and the coil being small and light enough to be directly mounted on the spark plugs or near the plugs in a region of high squish flow in an engine.

20 Claims, 4 Drawing Sheets

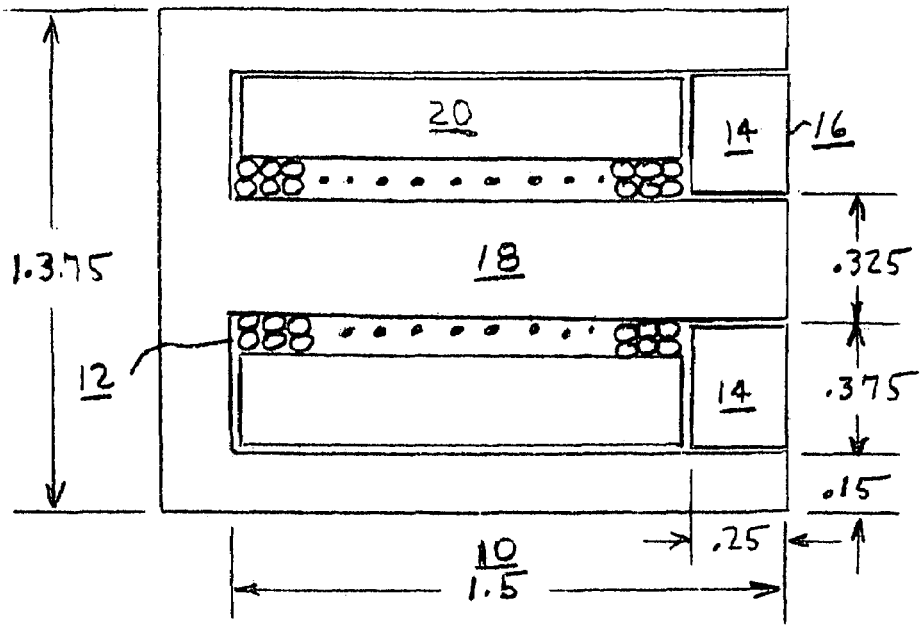
FIG 1A
FIG 1B
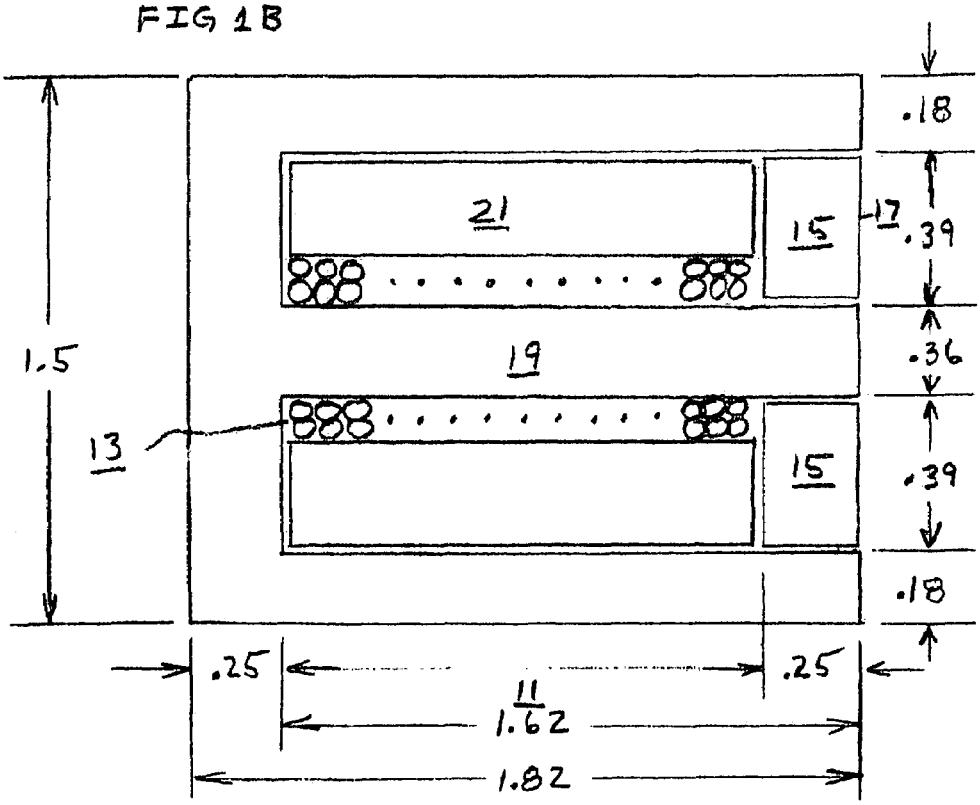

SPARK DURATION

SPARK DURATION

HIGH ENERGY DENSITY INDUCTIVE COILS FOR APPROXIMATELY 300 MA SPARK CURRENT AND 150 MJ SPARK ENERGY FOR LEAN BURN ENGINES

This application claims priority under USC 119(e) of provisional application Ser. No. 60/684,079, filed May 24, 2005, and Ser. No. 60/775,644, filed Feb. 22, 2006.

FIELD OF THE INVENTION

This invention relates to ignition systems for spark ignition internal combustion (IC) engines which have a high energy density inductive ignition coils with spark energy of approximately 150 millijoules (mj) which have spark currents of 200 to 600 milliamps (ma), as applied to lean burn high efficiency engines with high squish flow in the region of ignition.

BACKGROUND OF THE INVENTION AND PRIOR ART

The invention relates to high energy, flow-coupling, coil-per-plug inductive ignition systems with high energy density coils, operating at high voltage and current, for use more ideally with internal combustion engines which produce high flow at the spark plug site during ignition. Preferably, the invention relates to a 42 volt based coil-per-plug inductive ignition system as disclosed in my U.S. Pat. No. 6,142,130, referred to henceforth as '130, having high energy density coils of approximately 150 mj and high spark currents in the 200 to 600 ma range, and having a pair of biasing magnets in the open end of the E-core, as has been disclosed, in part, in my PCT patent application No. PCT/US03/12057, referred to henceforth as '057, published as WO 2003/089784 A3 on Oct. 30, 2003. The disclosures of '130 and '057, and other patents and patent applications cited below, are incorporated herein as though set out at length herein.

A central aspect of the present invention is that it has a spark current of approximately 300 ma, an energy of approximately 150 mj, a secondary turns Ns to primary turns Np ratio preferably equal to 60, i.e. Nt is between 53 to 67, where Nt=Ns/Np, and a primary turns Np between 60 and 90. In terms of a special ratio R which I define as Np/Nt, i.e. R≡Np/Nt, then R is greater than 1, and more precisely equal to 1.3, or between 1.15 and 1.45.

The term "approximately" or "approximately equal to" as used throughout this specification means within plus or minus 25% of the value it qualifies and the term "equal to" means plus or minus 12% of the value it qualifies, unless otherwise stated.

An aspect of the present invention is that it can be made to operate predominantly in the glow discharge mode, where 200 ma is the demarcation between the glow and arc. It can operate in the glow discharge mode, even above 200 ma, e.g. 400 ma, by selective use of electrode material, such as stainless steel. An advantage on the glow is that it is more erosion resistant than the arc discharge, and is also a more efficient discharge in low-flow or quiescent flow.

SUMMARY AND OBJECTS OF THE INVENTION

A high energy density and high efficiency inductive ignition coil of the ignition system disclosed in '130 is achieved by the use of biasing magnets ('057) located at the open end of the coil to substantially raise the coil energy density fivefold and double the coil efficiency. Novel use of low cost biasing magnets and coil winding structure, including winding with primary turns Np of between 60 to 90, and low turns ratio (Nt) of 53 to 67, or equal to 60, allows for a short, efficient cylindrical coil with spark energy of approximately 150 mj, i.e. 110 mJ to 190 mj range, and with secondary current preferably of approximately 300 ma, i.e. predominantly in the high glow and low arc. The special ratio R is equal to 1.3. The coil is a small and light enough to be directly mounted on the spark plugs or near the plugs.

The invention uses a mathematical and physical relationship developed by the present inventor, between coil input and output parameters, including coil energy and output capacitance, and other terms, to define a low coils turns ratio Nt which provides a best desired peak coil output voltage Vs(max) for a given maximum peak primary voltage Vp(max), e.g. using a 600 volt rated Insulated Gate Bipolar Transistor switch, or IGBT. As part of the definition of the complete ignition system, the value of secondary capacitance of the coil Cs and plug capacitance Cs(plug) of the spark plug capacitance is needed. For a typical car ignition coil with segmented, low capacitance secondary winding, 150 mj of coil energy allows for a low turns ratio Nt of the coil of equal to 60 for output voltage equal to 40 kV for 600 volts peak primary voltage using a 600 volt IGBT, instead of higher Nt of equal to 100 for a voltage equal to 40 kV as is found for typical low energy 50 mj coil using a 400 volt rated switch; or a coil turns ratio Nt of 70 with a primary turns less than Nt.

Another aspect of the invention is that the ignition coil is designed to have two sets of air-gaps in the core of the coil, a major and a minor pair of air gaps with biasing magnets located in the major air gaps length g1, and the minor air gap length g2, which may be zero, or adjusted along with the coil wire turns to provide more optimal operation. Such a coil structure is now improved to be "perfect laminated coils", as they will be referred to herein, in that they have a lamination design that results in no waste of the laminated material in the manufacture of the core. In such a design, the coil core is an open E-core which has three parts comprised of a center "T" leg and two outer "I" legs as shown in the drawings.

Another aspect of the invention relate to its preferred use in an engine with high flows at the spark plug site during the time of ignition. For example, given the preferred operation from a voltage source Vc of approximately 42 volts, as disclosed in my patent and patent application '130 and '057, one can use multi-firing of the ignition spark by use of a blocking diode on the secondary winding. This may be important in delivering much higher energy during engine cold start. That diode has to be able to block the forward voltage Vs+, approximately equal to 2*N*Vc, typically 5,000 volts in this preferred low turns ratio N design, which occurs on coil power switch Sw turn-on when the magnetic core is energized. That is, during switch Sw turn-on of the inductive system during multi-firing, a blocking diode Db allows conduction of the negative voltage Vs and current during spark firing, but blocks the forward voltage Vs+ with a blocking voltage Vb greater than Vs+. Spark duration of 10 milliseconds or longer, with approximately 80% duty cycle, are easily attainable for improved cold start and idle stability. Also, the peak spark currents of the spark pulses following the initial one can be significantly lower, e.g. 200 ma versus 400 ma, to reduce the otherwise high erosion during long duration multi-firing.

Also note that a blocking diode Db can be used with a recovery time Trec that is long relative to the frequency fo, e.g. 1 usec recovery time, so that during spark firing, the positive voltage overshoot that occurs, that can be greater than the breakdown voltage of the diode, e.g. 5 kilo Volts (kV), does not appear across the diode as it is still in a conducting state. On the other hand, the voltage rise Vs+ that appears during switch Swi closure on multi-firing of the coil is relatively slow, e.g. frequency f1 one tenth or lower than fo, so that the diode can successfully block the forward voltage Vs+.

Another aspect of the invention is to have one or both of its high voltage spark plug electrodes comprised of stainless steel (SS), whereupon for spark currents above 200 ma, the spark is in a predominantly glow discharge in a 400 to 500 volts at low air-flow, instead of the usual arc discharge (of about 150 volts at low air flow). If the high voltage electrode is comprised of SS or other material which produces a glow discharge at about 400 to 500 ma spark current at low air-flow, then the ground electrode is preferably erosion resistant material (or also SS).

Preferably, the plug as of the halo-disc type, which at one atmosphere and a spark gap of 0.070", has a lower breakdown voltage of approximately 7 kilovolts (kV), versus a standard plug with a similar gap which has a breakdown voltage equal to 10 kV.

Another aspect of the invention is the use of EI-3/8-LP or EI-1/2-LP laminated core of Thomas & Skinner, Inc., with larger winding windows than the standard 0.312", i.e. ⅜" window width by 1½" or by 1⅝" window length, for winding the primary and secondary wire, with typically 23 to 26 AWG (American Wire Gauge) primary wire of 60 to 90 turns Np, and turns ratio Ns/Np (Nt) of 53 to 67 turns ratio for a typical car ignition with a peak of approximately 40 kV. Secondary winding wire is of 36 to 40 AWG (American Wire Gauge) primary wire o 60 to 90 turns Np, an dturns ratio Ns/Np (Nt) of 53 to 67 turns ratio for a typical car ignition with a peak of approximately 40 kV. Secondary winding wire is of 36 to 40 AWG wire, and is of 3,500 to 5,500 turns of wire Ns. The primary inductance of the coil Lp is approximately 1.0 mH, i.e. between 0.75 to 1.25 mH. Biasing magnets are placed at the open ends of the laminations completing the magnetic core, and the coil energy is approximately 150 mj.

An object of the invention is to give a best embodiment of the invention, as a complete system, covering all the important aspects of both the coil and its best application to IC engines. Starting with the magnetic core, it is preferably a silicon-iron laminated core with an open-E structure which can be made up of stacked laminations with a square center core, made up of individual laminations, or a three part lamination made up of a center "T" leg and two "I" legs of a "perfect laminated coil", with a preferred core of width 1.44", center leg square core section of 0.36" by 0.36", and windows of width 0.36", and side legs of 0.18" width, and length of core between 1.7" and 2.0". The two biasing magnets are at the open ends, having length 0.36" (window width), width 0.36" (thickness of laminations), and height 0.30" (1.66 times the half width of 0.18") to have a magnetic bias of 2.0 Tesla given the biasing magnet has a flux of around 1.2 Tesla (1.2×1.66 equals 2.0 Tesla), and a magnetic energy density of a neodymium alloy magnet having an energy equal to 75 mj, or the two magnets having a total energy 150 mj. Note that the direction of the magnetic flux of the biasing magnetic is at right angles to the end of the core (a feature of the design which allows attainment of 2 Tesla). The primary winding can be either bifilar (27 AWG) or flattened single wire of 24 AWG, with two layers equal to 78 turns (Np), i.e. between 70 and 88, and turns ratio Nt equal to 60, giving a special ratio R equal to 1.3. The secondary turns Ns is equal to 4,680 of 38 AWG (37 to 39 AWG), i.e. 60×78, and are wound on a segmented bobbin of 9 to 11 bays, terminated at the high voltage end in a EMI suppressor wire. The energy of the coil is equal to 160 mj, i.e. 140 to 180 mj, and the spark current is expected to be approximately 320 ma, i.e. between 240 to 400 ma, depending in large part the actual value of Np, which gives a primary inductance Lp equal to 880 uH, i.e. between 770 uH and 1.0 mH. The coil is preferably used in an engine with high squish flow and lean burn (or high EGR), with spark plugs disclosed is several of my patents, including this one. The coil is preferably operated with approximately 42 volts, and can run at multi-pulsing, for example, at cold start, as disclosed in my patents and my patent applications. The coils can also be operated on my 2-valve, 2-plug engine, disclosed in my U.S. Pat. No. 6,267,107 B1, and it may include separate controls for the coils as given in patent application Ser. No. 10/511,517, and may use two different coils with different operation.

A point of clarification relates to the biasing magnets describes above. Each magnet relates to each half of the core, where the half-core area (at the open-E end) is 0.36" (core lamination thickness "t") by 0.18" (W/2). The biasing magnet has an area also of 0.36" ("t") but its other dimension "z" is along the core length, also "lm" of FIG. 4*b*, has a dimension approximately 1.5 times 0.18". That is, the direction of the biasing magnets field (horizontal) is at right angles the direction of the magnetic field at the end of the open-E (vertical), so the area of the biasing magnet can be larger that the respective core half to produce a flux of 2 Tesla in the core instead of just 1.2 Tesla of the magnet. That is, one dimension of the biasing magnets, "lm" of FIG. 4*b*, can be made larger that the equivalent dimension of the core, i.e. W/2 of FIG. 4*b*. In actuality, the magnetic fields at the adjacent regions of the biasing magnet and magnetic core end are distorted so that they are not at right angles but twisted and be more collinear.

Other features and objects of the invention will be apparent from the following detailed drawings of preferred embodiments of the invention taken in conjunction with the accompanying drawings,

BRIEF DESCRIPTION OF THE DRAWINGS

FIGS. 1*a* and 1*b* are approximately twice scale, top views of drawings of preferred embodiments of compact, open E-type ignition coils with two biasing magnets at the open ends, based on EI-3/8-LP (FIG. 1*a*) and EI-1/2-LP (FIG. 1*b*) Thomas & Skinner, Inc. laminations, with wider windows equal to ⅜", using silicon iron laminations or other core materials.

FIG. 3*a* is a standard plug, FIG. 3*b* is a halo-disc plug, and FIG. 3*c* is similar to a halo-disc plug but has a concave ceramic (versus convex) electrode insulating sheath as shown.

FIGS. 6*a* and 6*b* are coil secondary voltage Vs versus time graphs of the voltage occurring on and immediately following the initial spark breakdown (switch Swi opening). FIG. 6*b* shows switch Swi closures during multi-firing of the ignition coil respectively.

DISCLOSURE OF PREFERRED EMBODIMENTS

Figure 2A:
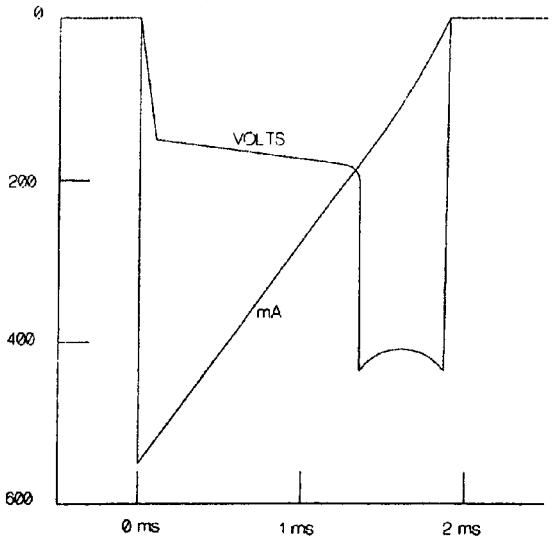
FIG. 2*a* and FIG. 2*b* are graphs of spark current (ma) and spark discharge voltage (volts) with spark duration in milliseconds (msec) for approximately 500 ma peak current, showing FIG. 2*a* the typical arc above 200 ma and glow discharge below 200 ma, and FIG. 2*b* showing the case of SS electrode(s) where the spark discharge is predominantly glow.

In a preferred embodiment the present invention, the primary winding is shown located on the inside, and the secondary winding is located on the outside in the preferred form of axially segmented windings, with typical turns ratio Nt between 54 and 66 for a preferred 38 kV to 45 kV peak output voltage. The primary inductance Lp of the coil is between 750 and 1,250 micro-Henry (uH) for the present high energy, high current application of stored energy approximately 150 mj, with round or flattened wire used for the primary wire, of typically 23 to 26 AWG. That is, the core made up of EI-3/8-LP and EI-1/2-LP laminations (Thomas & Skinner, Inc.) with wider windows equal to ⅜", shown in FIGS. 1*a* and 1*b*, with windows lengths 10 (1½") and 11 (1⅝") for the two drawings. The primary wire 12 and 13 may be flattened to stretch and fit the winding window length made up of initially round primary wire, so that the two layer winding may correspond to 1.2" and 1.3", or less, understanding that approximately ¼" wide magnets 14 and 15 may be placed at the open ends 16 and 17 of the laminations. The center leg 18 and 19 of the core may be equal to a square core of side ranging from 0.30" to 0.36", or a rectangle equal to 0.32" by 0.40".

In such embodiment, the secondary winding is preferably eight to ten winding bays, wherein the last flanges have thicker walls, as disclosed with reference to my other patents and patent applications '130 and '057. In such embodiment, 65 to 85 turns Np of two layers of primary wire are wound using 23 to 25 AWG, selected to fill the available winding length lp of 1.25" (FIG. 1*a*), i.e. 1.5"−0.25" magnet, or 1.37" (FIG. 1*b*) in the larger case (1.62"−0.25" magnet), with turns ratio Nt equal to 60, for a preferred peak output voltage equal to 42 kV, with 4,000 to 5,000 turns of 38 AWG for the wire of the secondary winding, i.e. between 37 and 39 AWG.

The primary peak charge current for this design, which is expected to have a primary inductance Lp of between 750 and 1,250 uH, is between 15 and 20 amps for a stored energy Ep between 100 and 180 mJ, depending on the more exact dimensions, wherein the lower energy is for an overall smaller size coil. The spark current is approximately 300 ma.

Taking a typical design for the smaller core of FIG. 1*a* (EI-3/8-LP with window width ⅜") with Lp=900 uH, Ip=19 A, Np=78 and lp 1.2", Acore=0.6 $cm^2$, secondary winding length 1.20" with 9 bays on the secondary turns 20, one has for the total magnetic flux swing Btot, stored energy Ep, and peak secondary current Is, and a turns ratio Nt is 58, $$Btot=(9*19)/(0.6*78)=3.65 \text{ Tesla}$$

$$Ep=\tfrac{1}{2}*0.9*(19^2)=160 \text{ mJ}$$

$$Is=Ip/Nt=19/58\approx 330 \text{ ma}$$

where the magnets can provide a magnetic flux bias of −1.85 Tesla and the charging current a peak flux of 1.8 Tesla. The primary wire is round wire of 22 AWG, or flattened round wire of 23 to 25 AWG. The secondary winding is equal to 4,500 turns.

For an open E-type ignition coil with two magnets at the end of the laminations, either as already disclosed in my U.S. patent application '057, or that is disclosed in FIG. 1*a* or 1*b*, a design may be preferred which has a peak secondary spark current of approximately 300 ma. In this example, is given a range of parameters covering the case of 300 ma of peak secondary current Is, and a peak primary current Ip of approximately 15 to 22 amps.

For assumed coil dimensions of 2.5", 1.5", and 1.2" (EI-1/2-LP laminations with wider window 17 of 0.39"), a bobbin 21 of length of 1.4" is assumed with ten bays and with two biasing magnets 15 at the open end, approximately 78 turns of primary winding (Np=78) of 23 to 25 AWG wire, and secondary turns Ns of 4,500 (turns ratio Ns/Np of 58) of 37 AWG to 39 AWG. The coil has inductance of approximately 1,000 uH (micro-Henry). The coil energy is typically 135 mJ to 180 mJ. The core area is assumed to be approximately 0.7 cm squared (center square core of sides 0.36"× 0.36" and two legs of width 0.18"). The biasing magnet dimensions 15 are approximately 0.38", 0.36", 0.25", there being very little magnetic flux leakage since the magnet 15 takes up the space between the center lamination and the outer laminations, e.g. magnet takes up 0.38"−0.39" of 0.39" space. Such a coil can be built to these dimensions (within 12%) with energy equal to 150 mJ and Ip equal to 18 amps (Is approximately 300 ma).The advantage of such a coil is that it has less than ½ the secondary turns, and an energy density of 4 to 5 times of a conventional coil, as well as ⅕ times the rise time (5 usecs instead of 25 usecs), and ⅕ times the charge time (0.5 msec instead of 2.5 msec). Since the spark current can be 300 ma, it can be in the glow-discharge mode for the major period of time, i.e. below 200 ma, ⅔ the time, which has advantages, including relatively low erosion. For the case where rapid air-motion exists, a predominantly arc discharge, versus glow discharge, predominates, and vice-versa. In an engine, rapid air-flow exists at higher RPM, and quiescent air-flow exists at low speeds and idle.

It is noted that a two layer, primary winding, may be shorter than 2×lp, so various options may be usable, such as flattening the round wire, winding the wire loosely on a primary bobbin, bifilar wire winding, or having the wire use up less that 2×Lp the length.

The invention, taken in part or as a whole, represent an improvement of the 42 volt based, high ignition flow-coupling, coil-per-plug ignition system previously developed and patented by myself for application to lean burn and high EGR engines, to simplify the design and packaging of parts and their inter-connection, as well as to improve the design and application of the coils and their operation, which will broaden their possible application.

With regard to defining the optimum turns ratio Nt, I have disclosed an improved way of doing this in patent application PCT/US05/32307, referred to henceforth as '307, which is of particular use for high energy coils, noting that the turns ratio Nt for a secondary maximum allowed peak voltage Vs is normally taken to follow the relationship:

$$Nt=Vsm/Vclamp$$

where Vclamp is the voltage at which the high end Vp of the primary coil winding of the ignition coil is clamped (to not exceed so as to not damage the switch Swi, which in this case is preferably 600 volt IGBT switches).

In the present case of the high energy, high efficiency coils used preferably in this ignition and disclosed in '130 and '057, a voltage doubling effect exists which is similar to that discovered by me and disclosed in my U.S. Pat. No. 4,677,960 ('960). In this case, it is reflected in a higher than expected maximum peak output voltage Vsm given by:

$$Vsm=[2*Nt/(1+Es/Ep)]*Vclamp$$

where Es/Ep is less than one, to give a reduced design turns ratio of:

$$Nt=[Vsm/Vclamp][1+Es/Ep]/2$$

where Es=the energy stored in the coil secondary capacitance, given by $\frac{1}{2}*Cs*Vsm^2$ and Ep=Epo−Esw−Elpe−Eclamp, where Epo is the energy stored in the coil, Esw is the energy dissipated in the switch Swi on switch opening, Elpe is the coil leakage energy, and Eclamp is the energy dissipated in the clamp after switch opening.

For example, assuming Vsm is 40 kV, Vp is 500 volts, then based on the conventional view, the required turns ratio Nt is given by:

$$Nt=40{,}000/500=80$$

From the equation disclosed, assuming Epo equals 160 mJ, and assuming Elpe, Eswitch, and Eclamp are each equal to 20 mJ, and:

$$Es=\frac{1}{2}*Cs*Vsm^2$$

where we assume Cs=50 picofarads (pF), 20 pF from the coil and 30 pF from the plug, $$Es=\frac{1}{2}*5*4^2\ mJ=40\ mJ$$

$$Nt=80*[1+40/(160-60)]/2=56\ \text{turns ratio}$$

which is much less than the 80 based on the conventional approach.

Taking the value of the previous case, i.e. Np=78, and the above value of Nt=56, then we have a special ratio R equal to 78/56, which equals to R=1.4, which is a value different from the values is previous disclosures, i.e. equal to or less than 1.0.

FIG. 2*a* shows graphs of spark current (ma) and spark discharge voltage (volts) against spark duration in milliseconds (msec) for approximately 500 ma peak current, showing the typical arc voltage of 150 to 200 volts for currents above 200 ma, and the typical glow discharge voltage of between 400 and 500 volts below 200 ma spark current. The curves are for a high energy coil of about 200 millijoules (mJ), under no or low flow conditions, as would be found at typical engine idle conditions used with a plug, as in FIGS. 3*a*–3*c*.

Figure 2B:
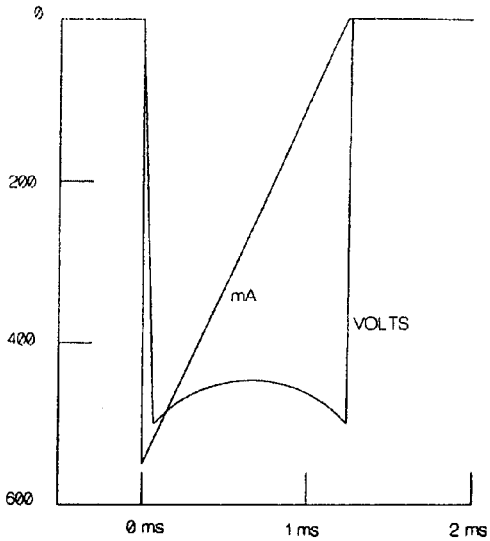

FIG. 2*b* shows discharge current and voltage for the case of SS electrode(s) where the spark discharge is predominantly glow with 400 to 500 volts, with 1.2 msec duration instead of approximately 2 msec duration in FIG. 2*a*. The spark energy is approximately 140 mJ, versus approximately 70 mJ for FIG. 2*a*. Hence, the energy delivery is higher for FIG. 2*b* (SS electrode(s)) given the absence of flow, or low air flow. In addition, the discharge of FIG. 2*b* (glow discharge) is less eroding than that of FIG. 2*a*, which has a significant arc duration and therefore promoting erosion.

The coil which created the spark as characterized in FIGS. 2*a*, 2*b*, had a primary turns Np of 70 turns (140 turns of bifilar wire), and a turns ratio Nt of 55. If Np was changed from 70 to 77 turns (one gauge smaller wire), then the spark current is reduced to approximately 450 ma instead of 550 ma, and for SS electrode(s) the spark current is dominantly glow discharge, i.e. the discharge voltage is 400 to 500 volts at the current peak of 450 ma.

Since the spark gap is preferred to be a larger gap of around 0.065" for better ignition, then if the source voltage Vc is as high as approximately 42 volts, then a blocking diode may not be needed on the secondary high voltage terminal. Also, one can also use multi-firing to a greater degree since the high voltage is almost entirely in the glow discharge (less erosion in the absence of the arc).

Figure 3A:
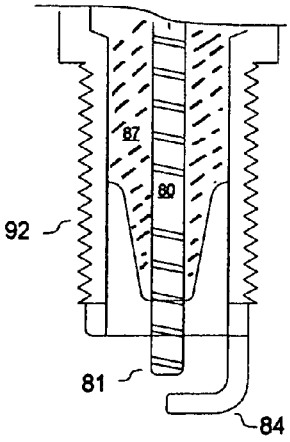
FIGS. 3*a*, 3*b*, and 3*c* are firing ends of spark plugs, where

As far as breakdown of the spark gap goes, a circular or toroidal gap as is found in the halo-disc plug has a lower breakdown voltage than a regular gap, 7 kV for 0.07" gap (FIGS. 3*b* and 3*c*), versus 10 kV or more for a regular gap (FIG. 3*a*).

Figure 3B:
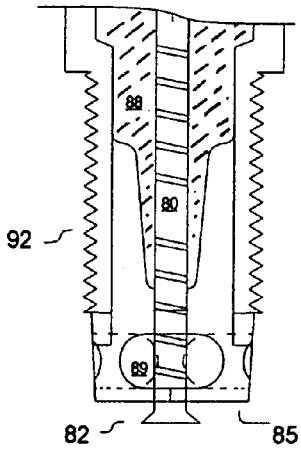
Figure 3C:
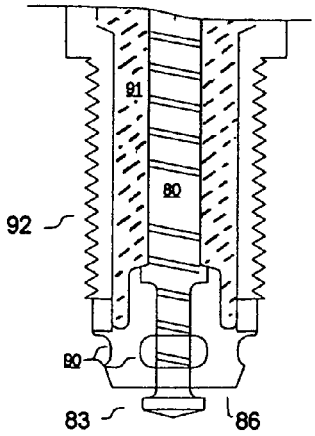

FIGS. 3*a*, 3*b*, and 3*c* are firing ends of spark plugs, where FIG. 3*a* is a standard plug, FIG. 3*b* is a halo-disc plug, and FIG. 3*c* is similar to a halo-disc plug but has a concave ceramic (versus convex) as shown.

The center electrodes of the plugs are conventional electrodes 80 with firing ends 81 for a standard plug and 82 and 83 firing ends for halo-disc type spark plugs. The firing ends 81, 82, and 83 are preferably SS for producing a glow discharge type spark for a spark current of 400 to 500 ma. The ground electrodes 84, 85, and 86 are preferably erosion resistant electrodes which can be SS or other material. The ceramic electrode insulating sheath 87 for FIG. 3*a* has a typical tapered end for a conventional plug, and the ceramic sheath low end 88 for a halo-disc plug is shown above the firing end and above the air-channel 89 with reference to the halo-disc plug of my U.S. Pat. No. 5,577,471. Likewise, a halo-disc plug of FIG. 3*c* has air-channels 90 behind the spark and a concave ceramic 91, as also shown in FIGS. 6*d* and 6*f* of International Application PCT/US03/12057 (filed 19 Apr. 2003). The sections 92 are the threaded outer shell of the plug.

The high voltage (HV) electrode(s) of a spark plug with a peak spark current above 200 ma are preferably stainless steel or other such material which can produces a glow, and as a result of the predominantly glow-discharge, the plasma discharge is more efficient at low flows rates, and the spark erosion is lower for the glow-discharge (electric supported discharge) than for the arc-discharge (molten metal discharge). The halo-disc type plug (FIGS. 3*b*, 3*c*), it has a longer life due to a larger circular or toroidal gap, and a lower breakdown voltage than the standard plug, but high enough that a blocking diode on the secondary is not required because it has a larger gap (0.065"). It is noted that the efficiency of the coil is high by the use of biasing magnets and a design based on my U.S. Pat. No. 6,142,130.

Figure 4A:
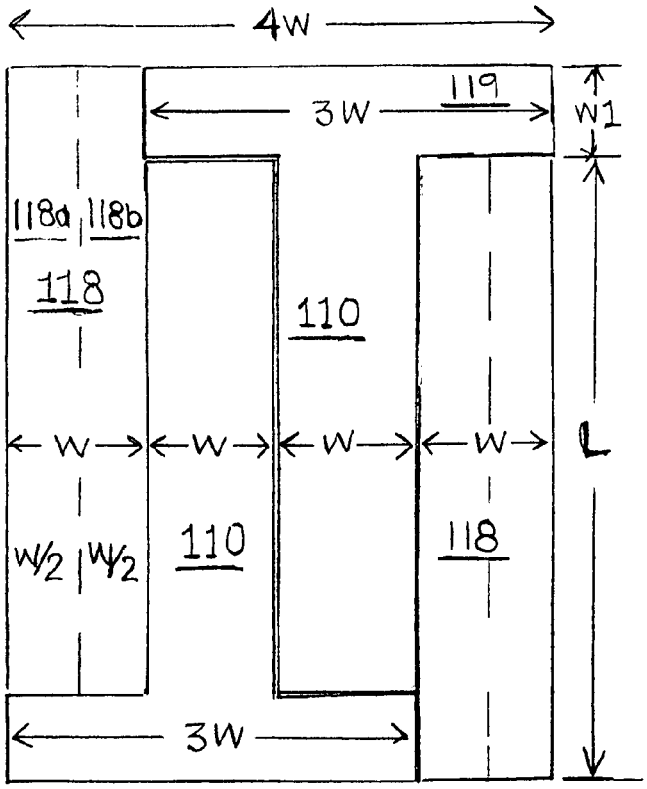
FIG. 4*a* is a an approximately twice scale of a preferred embodiment of a top view of a section of lamination strip of width 4W and length L+W1, out of which are cut two sets of laminations which produce no waste of the laminated material to defined a "perfect" laminated core for the coil of the present invention.

FIG. 4*a* is an approximately twice scale top view of a preferred embodiment of a section of lamination strip of SiFe magnetic material of width 4W and length L+W1, out of which are cut two sets of laminations, the center "T" sections 110 of center leg width "W", and the outer "I" legs

Figure 4B:
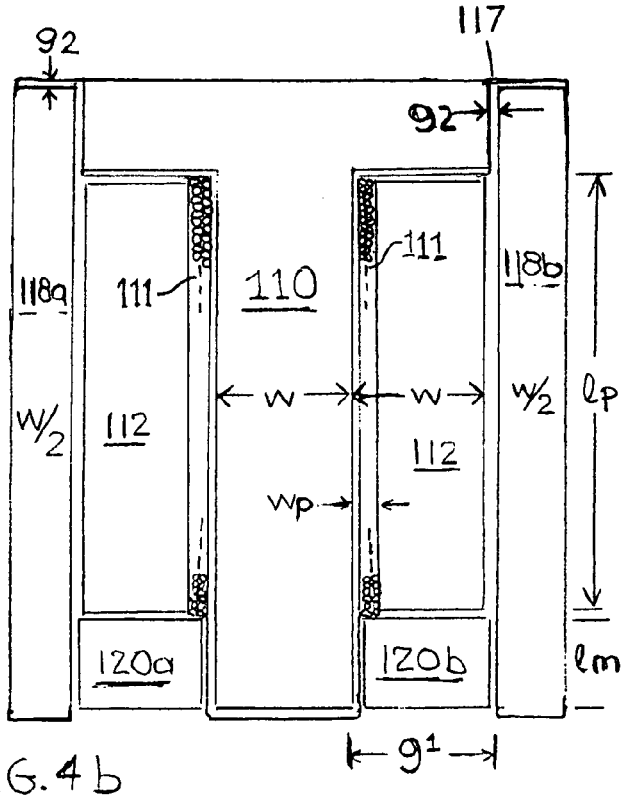
FIG. 4*b* is an approximately twice scale, partial top view of a preferred embodiment of a coil made from the "perfect" laminations of FIG. 4*a* excluding its housing.

118 also of width "W", which are slit along their length as indicated by the dashed line to make up the two sets of outer legs 118*a* and 118*b* of width "W/2" of the open-E core structure shown in FIG. 4*b* with biasing magnets 120*a* and 120*b* at the open ends. The width "W1" of the cross piece 119 is between W/2 and W, and the length "L" of the center leg is such as to accommodate the required lengths of windings and biasing magnets. In the preferred embodiment of an automotive coil with a stored energy of approximately 150 mJ, W is equal to 0.36", W1 is equal to 0.25", core length L is equal to 2.0", g2 (FIG. 4*b*) is zero (no air gap), leaving the coil core width at 1.44" (4 W).

FIG. 4*b* is an approximately twice scale, partial top view of a preferred embodiment of a coil made from the "perfect" laminations of FIG. 4*a*. Like numerals refer to like parts with respect to FIG. 4*a*. In this preferred embodiment, the gap 117 of length g2 is about equal to 0 (zero) to 0.025", the length "lp" of the primary winding 111 is equal to 1.45", and the length of the magnet "lm" is equal to 1.5×W/2 for the bias magnetic flux is equal to 2.0 Tesla, for rare earth magnets of flux equal to 1.3 Tesla, i.e. 1.3×1.5≈2 Tesla. The other dimensions of the magnets 120*a* and 120*b* are such as to conform to the major open end, i.e. one side being equal to or just under g1, and the other side being equal to W. In this preferred embodiment, the primary winding 111 is a two layer bifilar winding of turns Np equal to 68 to 82 to essentially fill the winding length lp, i.e. Np=lp/d, where d is the diameter of the magnet wire. The result is a primary inductance Lp of 400 uH to 1000 uH, preferably closer to the larger number. The turns ratio Nt is equal to 53 to 67, depending on the required peak output voltage Vspk, ranging typically from 56 for lower voltage Vspk of 38 kV, to 60 for Vspk of 42 kV for an output capacitance Cs of approximately 40 picofards (pF). The special ratio R (Np/Nt) equals to 1.2 to 1.6.

Figure 5:
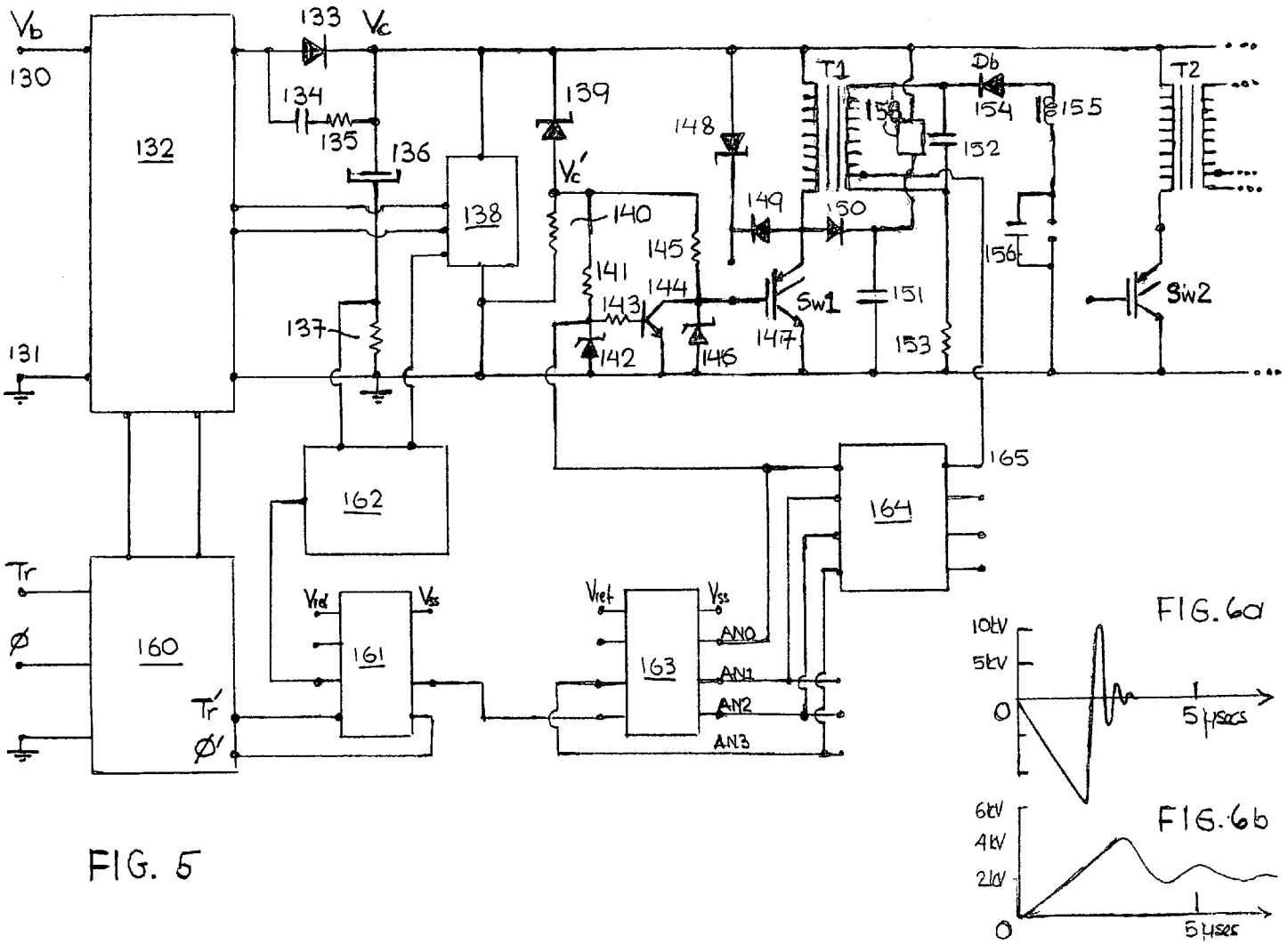
FIG. 5 is a partly circuit and partly block diagram of a preferred embodiment of the complete ignition system for use in a multi-cylinder engine.

FIG. 5 is a partly circuit and partly block diagram of a preferred embodiment of the complete ignition system for use in a multi-cylinder engine. To begin with, there is a supply voltage Vb (130), battery, and with a ground return 131. Power supply is a voltage of a higher voltage, e.g. 42V, with a output diode 133 and a capacitor 134 and resistor 135 across the diode 133. The power supply 132 delivers between 100 mJ and 300 mJ per ignition pulse in normal operation. Next is a capacitor 136 and current sense resistor 137 to ground. Energy storage on the capacitor 136 is much greater than that which is delivered by power supply 132 during a spark firing.

Next is a block 138 consistent of voltage regulator (e,g. 42V) and off-time timer. Next is a control Zener diode of approximately 16 volt (139) which does not let the ignition run when the ignition voltage is below 16 volt (14 volt). This circuit is used to turn on the switch swl when the voltage is greater then 16 volt. The parts of the circuit are well known and comprise of resistance 140, resistor 141, Zener diode 142, base resistor 143 of transistor 144, current limiting resistor 145 and diode 146.

Next is clamp diode 148 which is typically 550 volts with reverse diode 149 which protect primary circuit from exceeding 600 volts (protect 600 volts IGBT). When sw1 is activated and the diode 150 and capacitor 151 activated with small energy, the secondary coil circuit is energize to produce sparking current, that is, capacitor 151 and 152, 153 resistor, diode 154, inductive spark plug wire 155 and finally capacitance spark plug across the spark gap with capacitance 156. Coil T2 is shown to indicate more than one coil, with Sw2 IGBT and equivalent component as an coil T1. The block 158 connected to the capacitor 151 has either a resistor or inductor to allow the capacitor to discharge between firings, or an active component, e.g. switch means, to allow discharge of the capacitor in a controlled way.

The trigger and phase circuit is shown as block with Tr input, Phase input (phi), and ground (indicate as 160). These go to micro controller 161 which goes to control circuit 162 (known to those versed in the art), and micro controller with built in analog to digital converter circuit (e.g. 4 coils as indicate 163) optionally 164 can be used from either circuit or by other mean of getting the firing order. With the phase (phi) that gives four phase signals for a four cylinders, one does not need sensing circuit 164 and 165. Such phase signals are well known to those versed in the art.

FIGS. 6*a* and 6*b* are coil secondary voltage Vs versus time graphs of the voltage occurring on and immediately following the initial spark breakdown (switch Swi opening). FIG. 6*b* shows switch Swi closures during multi-firing of the ignition coil respectively. The diode Db (154) is, for example, a 5 kV diode to block the positive voltage on the switch Swi turn on, but is a slow turnoff diode to let a fast signal through. Note that a blocking diode Db can be used with a recovery time Trec that is long relative to the frequency fo, e.g. 1 usec recovery time, so that during spark firing, the positive voltage overshoot that occurs, that can be greater than the breakdown voltage of the diode, e.g. 5 kilovolts (kV), does not appear across the diode as it is still in a conducting state. On the other hand, the voltage rise Vs+ that appears during switch Swi closure on multi-firing of the coil is relatively slow, e.g. frequency f1 one tenth or lower than fo, so that the diode can successfully block the forward voltage Vs+.

In summary, a high energy density and high efficiency inductive ignition coil for an IC engine ignition system which preferably uses features that are disclosed is my patents and are also disclosed herein, namely that uses two biasing magnets located at the end of an open-E core such that the coil has a high energy density with spark energy of approximately 150 mj, or five times of a standard coil and double the coil efficiency, and novel use of the coil winding structure including winding with primary turns Np between 60 to 90, and more precisely between 70 and 86, i.e. 78±8 turns, and where the primary inductance is between 700 uH and 1,100 uH, and winding with a low turns ratio Nt equal to 60 for a high secondary voltage equal to 40 kV, and with secondary peak current of approximately 300 ma from 9 to 11 bays on the secondary, with special ratio R equal to 1.3, and where practical using SS spark plug electrodes or alloys of such or other which produce glow discharge at 300 ma during low flow in the engine cylinder, and arc at the high flows, and where practical using "perfected laminated coils" to make up the laminated core of the coil which can be cheaper since there is no or almost no waste.

Since certain changes may be made in the above apparatus and method, without departing from the scope of the invention herein disclosed, it is intended that all matter contained in the above description, or shown in the accompanying drawings, shall be interpreted in an illustrative and not limiting sense.

What is claimed is:

1. An inductive ignition system for an internal combustion engine operating at a voltage Vc substantially above the standard 12 volt automotive battery with one or more ignition coils T1 and associated power switches Swi, where i=1, 2, . . . n, with each coil having a primary winding of turns Np and inductance Lp, and a secondary high voltage winding for producing high voltage sparks of turns Ns and inductance Ls, the primary and secondary winding defining a turns ratio Nt equal to Ns/Np, the coils being of moderate inductance with two large air gaps within their magnetic core at the end of the open-E core and containing two biasing magnets at the open end of the open-E core which produce magnetic bias of around 2 Tesla or slightly less, and the coil producing an energy approximately 150 mj and spark of peak current Is of approximately 330 ma, and a secondary winding bobbin with segmented bobbin with 9 to 11 bays and producing a high voltage of 36 kV to 44 kV, the improvement comprising coil structure means which have the following:

a) the coil primary turns Np is between 68 and 88 turns making up two layers of flattened round or bifilar wire and having inductance of between 700 uH and 1,100 uH, b) the coils turns ratio Nt is between 50 and 67, c) a special ratio R is between 1.15 and 1.45, and d) a secondary turns of 3500 to 5500.

2. The ignition system of claim 1 wherein the primary wire is a bifilar wire of 26 to 27 AWG, equivalent to 23 to 24 AWG single round wire, and the secondary winding has a wire gauge between 37 and 40 AWG with a DC resistance less than 1000 ohms.

3. The ignition system of claim 1 wherein the power switch Swi comprises a 600 volt rating IGBT switch.

4. The ignition system of claim 1 wherein the voltage rating of the power supply is between 24 volts and 60 volts.

5. The ignition system of claim 1 wherein the coil output capacitance Cs is of a low value between 15 and 30 pf.

6. The ignition system of claim 1 wherein the laminations comprising the open-E core have laminations with no waste of the material in the manufacture of the core and having a three part laminated core comprised of a center "T" leg and two outer "I" legs.

7. The ignition system of claim 1 wherein the laminated core is of width equal to 1.44" comprised of 0.36" center leg and 0.36" winding window width and 0.18" outer legs, and core length of between 1.6" and 2.0".

8. The ignition system of claim 7 wherein the laminated core is of thickness approximately 0.36" so that the core is approximately square cross-section.

9. The ignition system of claim 1 wherein the biasing magnets have a length of 0.36", equal to the widow width, and a width equal to the core thickness "t", and a dimension "z" along the core length approximately 1.5 times the core outer leg width of 0.18", or 0.27".

10. The ignition system of claim 9 wherein the direction of the magnetic fields of the biasing magnet and the adjacent core ends are at right angles to each other and the regions where the magnetic fields are adjacent to each other are distorted so that they are not at right angles but twisted and are more collinear to each other.

11. The ignition system of claim 1 wherein the ignition spark is constructed to be multi-fired during cold-start of the engine and other conditions needing more ignition energy and has a slow blocking diode Db with a slow recovery time placed in the coil secondary of about 5 kilo-volts rating.

12. The ignition system of claim 11 wherein the subsequent multi-firing pulses have a peak spark current amplitude of equal to or less than 200 ma so that the subsequent multi-pulses are in the glow discharge mode.

13. The ignition system of claim 1 wherein at the intersection of the coil primary and power switch Swi there is a diode and capacitor connected to ground and the other side of the capacitor is connected to the voltage power supply Vc through an electrical device to allow the capacitor to controllably discharge its energy upon and after ignition firing.

14. An inductive ignition system for an internal combustion engine operating at a voltage Vc substantially above the standard 12 volt automotive battery with one or more ignition coils T1 and associated power switches Swi, where i=1, 2, . . . n, with each coil having a laminated core and a primary winding of turns Np and inductance Lp, and a secondary high voltage winding for producing high voltage sparks of turns Ns and inductance Ls, the primary and secondary winding defining a turns ratio Nt equal to Ns/Np, the coils being of moderate inductance with two large air gaps within their magnetic core at the end of the open-E core and containing two biasing magnets at the open end of the open-E core which produce magnetic bias of around 2 Tesla or slightly less, and the coil producing an energy approximately 150 mj, and a coil structure that has a lamination design that results in no waste of the laminated material in the manufacture of the core and which has three parts comprised of a center "T" leg and two outer "I" legs, using whole laminated material rectangular sheets, and two sets of laminated open-E cores per rectangular sheet section.

15. The ignition system of claim 14 wherein the laminated core is of width equal to 1.44" comprised of 0.36" center leg and 0.36" winding window width and 0.18" outer legs, and core length of between 1.6" and 2.0", and the "T" and "I" legs are at a ground potential.

16. The ignition system of claim 14 wherein the two basing magnets have a length equal to the spacing between the surface of the center "T" leg and the surface of the outer "I" leg, equal to g1, and a width equal to the thickness "t" of the lamination, and the third dimension "lm" approximately 50% larger that the equivalent core dimension.

17. An inductive ignition system for an internal combustion engine operating at a voltage Vc substantially above the standard 12 volt automotive battery with one or more ignition coils T1 and associated power switches Swi, where i=1, 2, . . . n, with each coil having a primary winding of turns Np and inductance Lp, and a secondary high voltage winding for producing high voltage sparks of turns Ns and inductance Ls, the primary and secondary winding defining a turns ratio Nt equal to Ns/Np, the coils being of moderate inductance with two large air gaps within their magnetic core at the end of the open-E core and containing two biasing magnets at the open end of the open-E core which produce magnetic bias of around 2 Tesla or slightly less, and the coil producing an energy of approximately 150 mj, and the ignition system having spark plugs with high voltage spark plug electrodes comprised of stainless steel (SS) alloy and ground electrodes, constructed and arranged so that for spark currents above 200 ma, the spark is in a predominantly glow discharge in a 400 to 500 volts at low air-flow, instead of the usual arc discharge of about 150 volts at low air flow, which produces a glow discharge at about 400 to 500 ma spark current at low air-flow.

18. The system of claim 17 wherein the ground electrode thereof is made of erosion resistant material such as tungsten-nickel-iron.

19. The system of claim 17 wherein the spark plug is a halo-disk type plug with circular spark gap and has a lower firing gap than a j-type standard plug.

20. The system of claim 19 wherein the ceramic at the plug end has a concave shape instead of the usual convex shape of the halo-disc plug.

* * * * *